United States Patent [19]

Santopietro et al.

[11] Patent Number: 4,517,981

[45] Date of Patent: May 21, 1985

[54] ORTHOTIC DEVICE

[76] Inventors: Frank J. Santopietro, 6 Calvin Rd., Jamaica Plain, Mass. 02130; Thomas V. Santopietro, Jr., 9 Chestnut Hills Ct., Greenville, R.I. 02828

[21] Appl. No.: 502,208

[22] Filed: Jun. 8, 1983

[51] Int. Cl.[3] ..... H61F 5/14

[52] U.S. Cl. ..... 128/581; 128/617

[58] Field of Search ..... 128/800, 581, 586, 595, 128/615, 616, 617

[56] References Cited

U.S. PATENT DOCUMENTS 2,044,233 6/1936 Wagner ..... 128/617

2,680,919 6/1954 Riggs ..... 128/617

FOREIGN PATENT DOCUMENTS 1007928 of 1952 France ..... 128/617

*Primary Examiner*—Richard J. Apley

*Assistant Examiner*—David J. Brown

[57] ABSTRACT

Disclosed is an improved device for supporting the human foot in a more anatomically neutral, more correct position while the foot is in a weight bearing position both in stance and/or while functioning throughout gait in walking, running, or skiing. The present invention is particularly suited to high arched as well as flat feet. The device supports the foot from the metatarsal head area of the foot to the heel. The device includes a wedge that starts low in the heel area and very gradually increases towards the forefoot area so that it is highest in the forefoot area under the second metatarsal head. The wedge drops off abruptly under the first metatarsal head to a level that forms a neutral plane or valgus (lateral) wedge or valgus relationship of a plane from the first metatarsal head to the fifth metatarsal head with the rearfoot. In biomechanical terms, the device is designed to provide a rearfoot varus wedge of from 2 to 7 degrees. This varus wedge is started at the very back of the heel and is gradually increased towards the forefoot area so that there is a maximum amunt of varus wedging under the second metatarsal head which includes a rearfoot wedging and an additional forefoot wedge of from 1 to 10 degrees, and preferably from 3 to 10 degrees. There is no buildup to create a wedging under the first metatarsal head greater than the amount of the rearfoot wedge, thus providing for a neutral or valgus (lateral) wedge from the first to the fifth metatarsal heads.

11 Claims, 24 Drawing Figures

FIG. 5
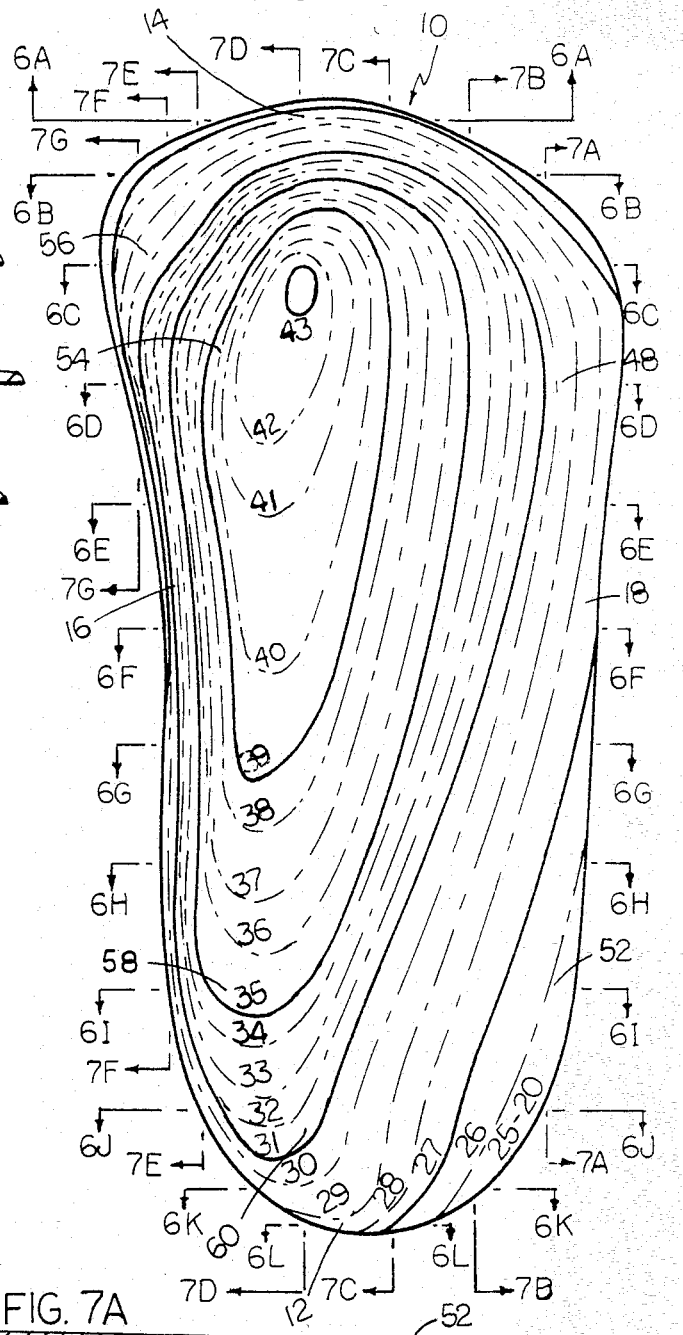
FIG. 6A
FIG. 6B
FIG. 6C
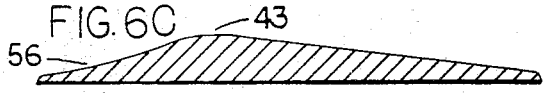
FIG. 6D
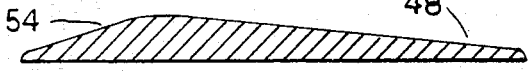
FIG. 6E
FIG. 6F
FIG. 6G
FIG. 6H
FIG. 6I
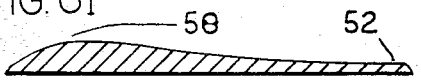
FIG. 6J
FIG. 6K
FIG. 6L
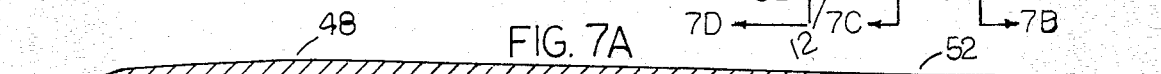
FIG. 7A
FIG. 7B
FIG. 7C
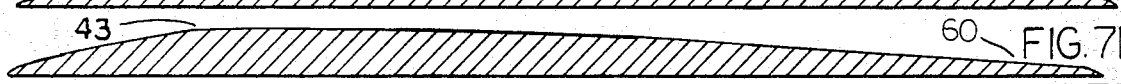
FIG. 7D
FIG. 7E
FIG. 7F
FIG. 7G

ORTHOTIC DEVICE

DESCRIPTION OF THE PRIOR ART

The extensive use of foot supportive devices for both regular street use and athletic use has emphasized the need for relief of foot pain and foot related lower extremity pain. It has been stated that foot problems plague greater than sixty percent or more of the American population.

Prior art devices do not provide a generalized single foot supporting device which is both supportive in a correct biomechanical relationship for high arched and flat feet for a large portion of the population, and at the same time, which will fit into most shoes, including women's dress shoes.

Foot supports, which have various configurations and shapes, have been known for many years. None, however, has been devised with the unique features of the present invention. Prior foot supporting devices have concentrated on building up only specific portions of the device located under the cuboid, under the heel, under the phalanges, under the metatarsals, and other various specific positions. Almost all of these prior art devices have consisted of placing pads in these specific areas. None of the prior art devices have configurated the biomechanical relationships as is now provided by the present invention. None of the prior art devices have identified an average of the high arched foot and the flat foot as the present invention does. Prior foot supporting devices define the heel areas as curved and thicker along the outside heel borders in contradistinction to the present invention.

SUMMARY OF THE INVENTION

Each joint of the human foot has a specific function related to a certain range of motion. The functions of the foot are to provide mobile adaptation to the ground, to provide shock absorption, to act as a rigid lever for propulsion and to transfer the body weight forward.

These functions are provided more specifically by the subtalar joint and midtarsal joint, as well as other foot joints, in conjunction with the ankle joint, knee joint, and hip joint. Through the examination and study of thousands of individuals with various foot types, it can be determined that human feet can be classified into substantially two basic foot types with variations between these two foot types. The foot types can be either high-arched or flat foot types with specific small variations and combinations.

The present invention takes into account that most individuals fit into these two foot types with some minor modifications, specifically in the first metatarsal's relationship to the rest of the foot. Feet can be classified as high-arched feet with too much or too little motion or flat feet with too much or too little motion in the subtalar joint.

A neutrally functioning foot should ideally hit the ground in a slightly supinated or high-arched position, and after contacting the ground, should pronate or flatten out to conform to the ground. There ideally should always be some motion of the subtalar joint in a pronating or flattening maneuver after the foot makes contact with the ground. This is true for neutral, flat and high-arched feet. The reason for this motion is to conform or adapt the foot to the ground and thereby absorb or dissipate shock.

There are, however, neutral, flat and high-arched feet which are already pronated or flat at heel strike or foot contact and therefore cannot use the subtalar joint to absorb shock. Most high-arched and flat feet have a greater range of supination than of pronation so that both of these foot types can be wedged along the inside to their advantage at heel strike and during the rest of the stance phase of gait. The wedge along the inside of the device of the present invention serves to slow down and/or limit pronation or flattening in the flat foot. Further, the present device places the high-arched foot in a more supinated position so that the foot can flatten out or pronate after hitting the ground, thereby utilizing the motion of the subtalar joint which was not being used prior to the wedging. The present invention utilizes this principle by incorporating a rearfoot medial wedge.

In addition to the differences of the amount of motion of the rearfoot between high-arched and flat feet, there usually is a major difference between the forefoot of a high-arched and flat foot. In a high-arched foot, the first metatarsal is generally lower than the other metatarsals and lower in relationship to the plane of the rearfoot or undersurface of the heel. This is referred to as being plantarflexed. This is usually in a fixed or rigid position which means that it does not bend when weight is placed on the foot. Depending on how rigid this first metatarsal is will determine if the rearfoot or subtalar joint will be allowed to pronate or flatten after heel contact, provided that there is enough motion in the rearfoot to flatten or pronate. The plane through the second through the fifth metatarsal heads, however, is usually on the same plane as the rearfoot or undersurface of the heel or is in a plane higher than the rearfoot.

In a device for a high-arched foot, then, it is beneficial that the first metatarsal should be allowed to fall below the level of the plane of the rearfoot or "floated", so that the first metatarsal does not push against the ground to limit motion of the rearfoot in pronation. It is also beneficial that a device for the high-arched foot should maintain the plane of the rearfoot under the second through the fifth metatarsals.

So an ideal device for most high-arched feet should have a medial wedge in the rearfoot area and a slightly higher medial wedge under the area through a plane defined from the second through fifth metatarsal heads, with a lower area under the first metatarsal area to allow the first metatarsal to "float". This relationship of the first to the fifth metatarsal head area is called a valgus forefoot or a lateral wedge.

In a flat foot, the first metatarsal is usually elevated in relationship to the plane of the rearfoot or undersurface of the heel. In relationship to the other metatarsals, the first metatarsal in a flat foot can be at the same level, higher or lower. In almost every instance, however, this first metatarsal is very flexible which means that it bends easily when weight is placed on the foot and allows the rearfoot to flatten out or pronate with no resistance.

In a device for a flat foot then, it is beneficial that the first metatarsal through the fifth metatarsal plane be slightly higher than the plane of the rearfoot, so as to limit the motion of the rearfoot in a pronating or flattening direction. The group of flat feet, however, that have a first metatarsal that is lower in relationhship to the other metatarsals and/or to the plane of the rearfoot would not be comfortable in this device unless the first metatarsal were allowed to fall below the level of the plane of the rearfoot or "float".

So an ideal device for most flat feet would therefore have a medial wedge in the rearfoot area and a higher medial wedge under the forefoot area from the first through the fifth metatarsal heads with a lower area under the first metatarsal area to allow the first metatarsal area to "float".

Flatfooted people who have custom orthotics constructed for them will generally have the inside of the heel raised by a few degrees and the inside of the forefoot raised a few more additional degrees. High-arched people who have custom orthotics constructed will generally have the inside of the heel raised by a few degrees and the outside of the forefoot raised a few degrees.

Heretofore no orthotic device has been available which would provide the specific configuration to serve both these foot types and would offer better mechanics and desirable comfort for both. The present invention admirably provides a mor scientific approach and configuration which can be used comfortably by high-arched, flat-footed, and normally arched people alike, and which advantageously corrects the foot problems discussed herein.

OBJECTS OF THE INVENTION

Therefore, it is one object of the present invention to provide an orthotic arch support for use by the general public for street shoe use and in athletic footwear which helps to relieve discomfort and pain caused by excessive stress to the anatomical structures of the foot and leg placed on it during standing, walking, running or in various athletic maneuvers.

A further object of the present invention is to provide high-arched feet with a medial wedge buildup in the heel to aid in allowing normal pronation of the foot at heel strike and soon thereafter, and then allow the first metatarsal to seek a lower level than the fifth metatarsal in the midstance or support phase of gait, thus allowing for a more functional subtalar joint and a more neutrally functioning foot.

Another object of the present invention is to provide the flat foot with a medial wedge buildup in the heel in the same way as for the high-arched foot, but to aid in slowing or limiting pronation, as opposed to facilitating pronation in the high-arched foot.

Still, a further object of this device is to allow for supporting the second metatarsal higher than the fifth metatarsal while, at the same time, supporting the rearfoot along the medial or inside of the heel and arch.

An additional object of the present invention is to act in conjunction with the heel counter of the shoe to provide biomechanical support to the foot without interfering with shoe fit by excessive thickness of the device along the outside heel edges.

Other objects and advantages of the present invention will be pointed out specifically or will become apparent from the following description when it is considered in conjunction with the appended claims and the accompanying drawing.

BRIEF DESCRIPTION OF THE DRAWINGS

FIG. 5 is contour view of the device, plantar aspect (for left foot). Each contour line or segment represents 1/24th or 0.041 of the total thickness of the orthotic device.

FIGS. 6A–6L are a series of transverse cross sectional views of FIG. 5 taken respectively along cross sectional lines 6A–6L.

FIGS. 7A–7G are a series of longitudinal cross sectional views of FIG. 5 taken respectively along cross sectional lines 7A–7G.

DETAILED DESCRIPTION OF THE PREFERRED EMBODIMENT

Figure 1:
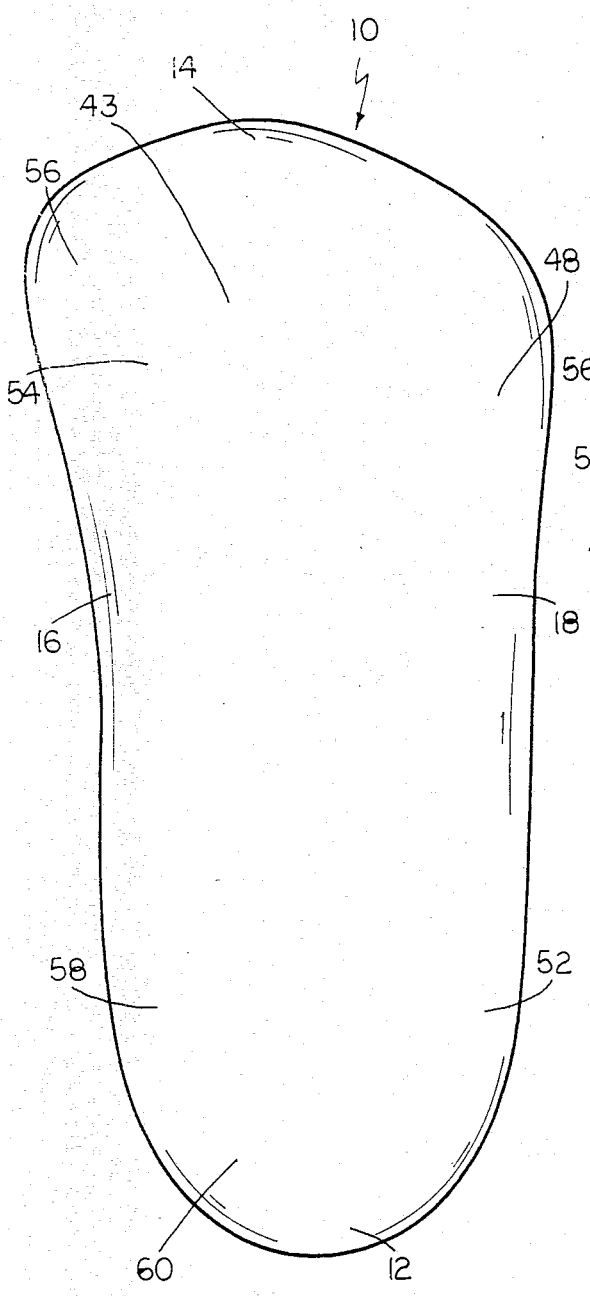
FIG. 1 is a top view of the orthotic device of the present invention configured for a right foot or a bottom view of the orthotic device for a left foot.

With initial reference to FIG. 1, there is shown a top view of the orthotic device 10, the present invention. Device 10 includes a rearfoot or heel portion 12 and front or forefoot portion 14 and opposing sides, medial 16 and lateral 18.

Device 10 may be constructed of any desired rigid or semi-rigid material as for example: semi-rigid cellular foam, rubber or polypropylene. If desired, device 10 can be constructed of rigid plastics or other materials.

Figure 2:
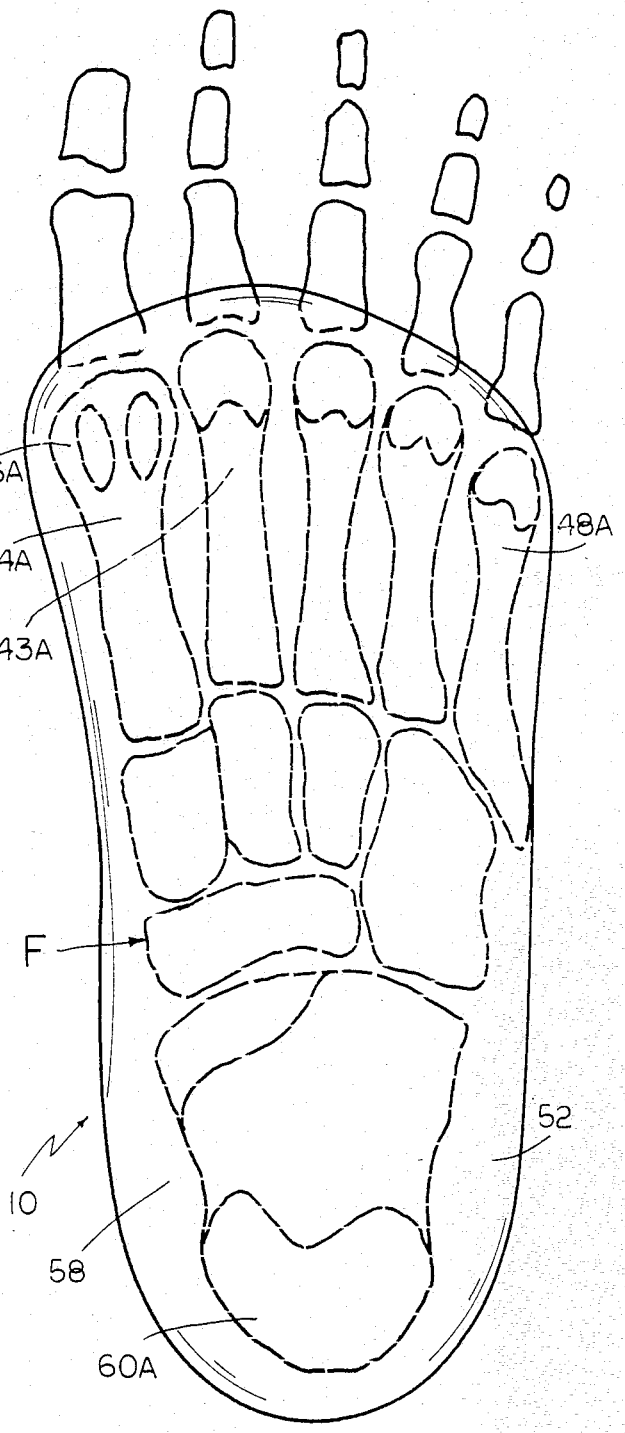
FIG. 2 is a bottom view of the orthotic device of FIG. 1 positioned under the left foot plantar aspect.
Figure 3:
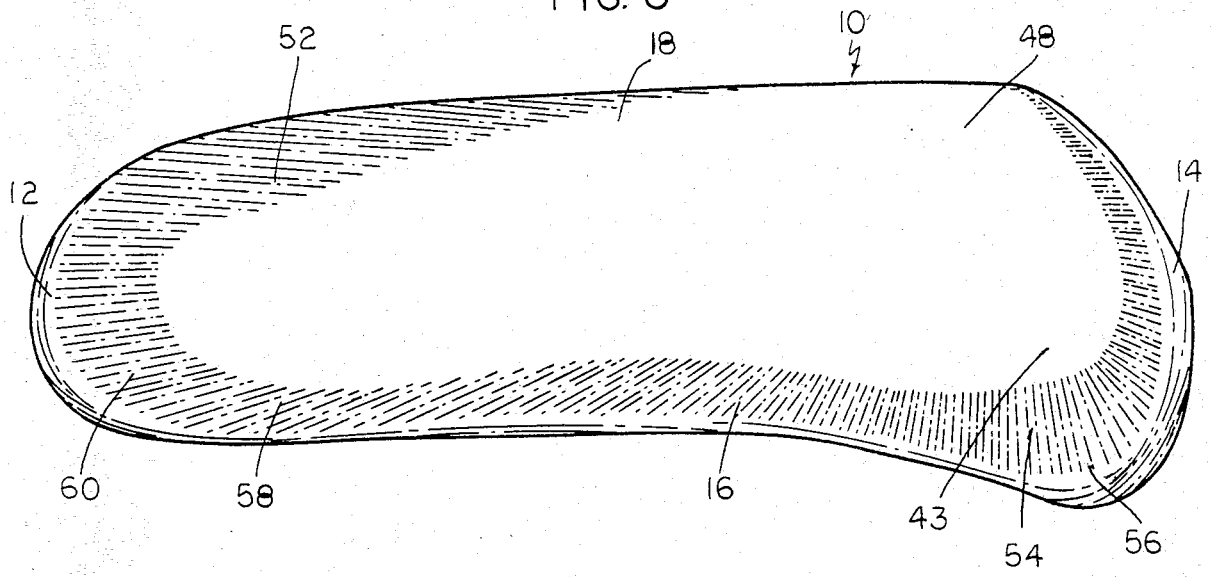
FIG. 3 is a perspective view of the orthotic device of FIGS. 1 and 2, plantar aspect (for right foot).
Figure 4:
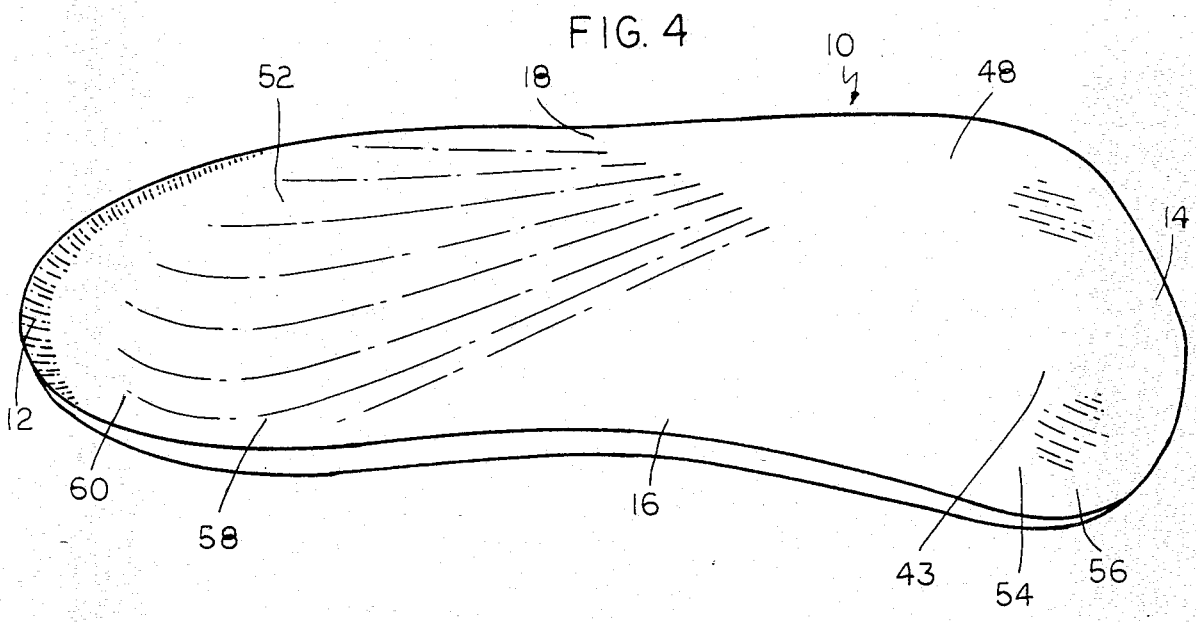
FIG. 4 is a perspective view of the orthodic device of FIGS. 1 and 2, dorsal aspect (left foot) after molding.

Device 10 as shown in FIG. 5 is a contour chart of device 10 compromising 24 layers or segments. These 24 contour segments are numbered from the thinnest segment 20 to the thickest segment 43. The thickest portion of the device 10 numbered 43 in FIG. 5 is situated supporting the second metatarsal neck area 43A of the foot F as shown in FIG. 2. Other sectional views of device 10 that locate support for the second metatarsal neck area 43A of foot F as shown in FIG. 2, are shown at location 43 in FIGS. 6C and 7D.

The thickness of device 10 at location 48 (FIGS. 5, 6D and 7A), segment 30 FIG. 5 supports the fifth metatarsal neck area 48A of the foot F as shown in FIG. 2. The thickness of the device 10 at location 48 (FIG. 5) is slightly higher than the thickness of the device 10 at location 52 (FIG. 5). The thickness of device 10 at location 54 (FIG. 5) supporting the first metatarsal neck area 54A of the foot F (FIG. 2) is lower than location 43. Location 54 (FIG. 5) of device 10 can be lower than, equal to, or higher than location 48 (FIG. 5) as long as the relationship of the device 10 at location 54 (FIG. 5) to the location of the device 10 at 48 (FIG. 5) is in a valgus relationship to the rearfoot transverse plane. The highest portion of the device 10 at location 43 (FIG. 5) slopes down in a gentle wedge to the portion of the device 10 at location 48 (FIG. 5). The device 10 at location 43 (FIG. 5) slopes down more abuptly to location 56 (FIG. 5) also shown in FIG. 6C.

In device 10 the relationship of the location 43 (FIG. 5) supporting the area under the second metatarsal neck area of the foot has been described in relationship to location 48 (FIG. 5) supporting the fifth metatarsal neck area of the foot F (FIG. 2) in terms of height. The relationship can be further defined in biomechanical terms.

The preferred embodiment consists of a medial rearfoot wedge as shown in FIG. 6I, which as described before can range from 2 degrees to 7 degrees with the medial side 16 (FIG. 1) being the higher side of the wedge. The angle of the wedge can be defined as a plane from location 52 to 58 as shown in FIGS. 5 and 6I. The wedge gradually increases toward the front of the device 10 as shown in FIGS. 6H through 6C. The forefoot varus wedge of the device 10 from location 43 to location 48 supporting the second metatarsal neck area to the fifth metatarsal neck area of the foot can range from 1 to 10 degrees, and preferably 3 to 10 degrees.

The preferred embodiment of this invention as described in device 10 has described location 43 (FIG. 5) as the highest portion of the device and all other areas lower than this area. The relationship of location 43 (FIG. 5) of device 10 to the heel location 60 (FIG. 5) is such that a gentle slope exists from the high location 43 to the lower location 60. This slope may vary depending on the wedge which is defined by FIGS. 6I and 6D. The medial wedge defined by FIG. 6I should range from 2 to 7 degrees and the medial wedge defined by FIG. 6D should range from 1 to 10 degrees, and preferably 3 to 10 degrees. Therefore the slope as shown in FIG. 7D will vary accordingly.

From the foregoing it will be seen that the present invention provides a new and novel orthotic device contributing to improved support for the human foot and offering correct positions of the foot in a more anatomically correct, neutral position of the foot in both stance and action positions than has heretofore been available.

What is claimed is:

1. An improved orthotic device for supporting a human foot in a substantially correct anatomical position, said device including a forefoot portion, a rearfoot portion and opposing medial and lateral sides, said medial and lateral sides being disposed on opposing sides of a midline extending longitudinally of the device, a wedge portion, the lowest portion starting in the rearfoot portion of the device and increasing to the forefoot portion of the device and terminating in a highest point of the device at a first locus toward the forefoot portion of the device and disposed intermediate the midline of said device and said medial side and adapted to underlay and support the second metatarsal head area of said foot, and a second locus disposed toward the rearfoot portion of the device and disposed intermediate the midline of said device and said medial side, said wedge portion including first and second sloping portions meeting at a ridge, said first sloping portion extending from said ridge to said medial side and said second sloping portion extending from said ridge to said lateral side, and said ridge extending longitudinally from said first locus to said second locus, said ridge being generally in a straight path intermediate said midline and said medial side.

2. An improved orthotic device as set forth in claim 1 wherein said wedge portion inclines from between 2 to 7 degrees from the rearfoot portion to the forefoot portion of the device.

3. An improved orthotic device as set forth in claim 1 wherein said second portion proximate said first locus declines from said ridge from between 1 to 10 degrees, and preferably from 3 to 10 degrees.

4. An improved orthotic device as set forth in claim 1 wherein said second sloping portion in said rearfoot portion declines from between 2 to 7 degrees from said ridge.

5. An improved orthotic device as set forth in claim 1 wherein the first metatarsal neck area of said human foot is supported on said first slope in a first support area in a transverse plane passing generally through said first locus, and a fifth metatarsal neck area of said foot is supported on said second slope in a second support area in said transverse plane, said first support area being equal in height to said second support area.

6. An improved orthotic device as set forth in claim 1 wherein the first metatarsal neck area of said human foot is supported on said first slope in a first support area in a transverse plane passing generally through said first locus, and a fifth metatarsal neck area of said foot is supported on said second slope in a second support area in said transverse plane, said first support area being lesser in height to said second support area.

7. An improved orthotic device as set forth in claim 1 wherein the first metatarsal neck area of said human foot is supported on said first slope in a first support area in a transverse plane passing generally through said first locus, and a fifth metatarsal neck area of said foot is supported on sid second slope in a second support area in said transverse plane, said first support area being greater in height to said second support area.

8. An improved orthotic device for supporting a human foot in a substantially correct anatomical position, said device including a forefoot portion, a rearfoot portion and opposing medial and lateral sides, said medial and lateral sides being disposed on opposing sides of a midline extending longitudinally of the device, a wedge portion, the lowest portion starting in the rearfoot portion of the device and increasing to the forefoot portion of the device and terminating in a highest point of the device at a first locus toward the forefoot portion of the device and disposed intermediate the midline of said device and said medial side and adapted to underlay and support the second metatarsal head area of said foot, and a second locus disposed toward the rearfoot portion of the device and disposed intermediate the midline of said device and said medial side, said wedge portion including first and second sloping portions meeting at a ridge, said first sloping portion extending from said ridge to said medial side and said second sloping portion extending from said ridge to said lateral side, said ridge extending longitudinally from said first locus to said second locus, said ridge being generally in a straight path intermediate said midline and said medial side, said wedge portion inclining from between 2 to 7 degrees from said rearfoot portion to said forefoot portion, said second sloping portion in the area proximate to said first locus declining from said ridge from 1 to 10 degrees, and said second sloping portion in said rearfoot portion declining from between 2 to 7 degrees from said ridge.

9. An improved orthotic device as set forth in claim 8 wherein the first metatarsal neck area of said human foot is supported on said first slope in a first support area in a transverse plane passing generally through said first locus, and a fifth metatarsal neck area of said foot is supported on said second slope in a second support area in said transverse plane, said first support area being equal in height to said second support area.

10. An improved orthotic device as set forth in claim 8 wherein the first metatarsal neck area of said human foot is supported on said first slope in a first support area in a transverse plane passing generally through said first locus, and a fifth metatarsal neck area of said foot is supported on said second slope in a second support area in said transverse plane, said first support area being lesser in height to said second support area.

11. An improved orthotic device as set forth in claim 8 wherein the first metatarsal neck area of said human foot is supported on said first slope in a first support area in a transverse plane passing generally through said first locus, and a fifth metatarsal neck area of said foot is supported on said second slope in a second support area in said transverse plane, said first support area being greater in height to said second support area.

* * * * *